United States Patent [19]

Best

[11] Patent Number: 4,977,638

[45] Date of Patent: Dec. 18, 1990

[54] DUST COLLECTION APPARATUS

[76] Inventor: Albert M. Best, 5 Kutz Ave., New Holland, Pa. 17557

[21] Appl. No.: 402,559

[22] Filed: Sep. 5, 1989

[51] Int. Cl.[5] ..... F23J 1/00; A47L 5/36

[52] U.S. Cl. ..... 15/301; 15/314; 15/331; 15/339; 55/419; 144/252 R

[58] Field of Search ..... 15/301, 303, 314, 327 R, 15/328, 347, 339, 331; 137/625, 625.11, 625.15, 602, 613, 625.46; 144/252; 406/117; 55/419

[56] References Cited

U.S. PATENT DOCUMENTS

| | | | |
|---|---|---|---|
| 823,506 | 3/1885 | Cadorette et al. | 144/252 |
| 976,744 | 3/1876 | Needham | 406/117 X |
| 1,029,531 | 1/1970 | Day | 406/117 X |
| 1,048,477 | 12/1912 | Allington | 15/301 |
| 1,124,505 | 2/1964 | Needham | 406/117 X |
| 1,871,995 | 5/1987 | Jennings et al. | 406/117 X |
| 3,332,218 | 1/1964 | O'Dell | 137/625.15 |
| 3,343,197 | 9/1967 | Carsey | 15/314 |
| 3,520,327 | 6/1970 | Claydon et al. | 137/625.11 |
| 4,201,256 | 5/1980 | Truham | 144/252 A |
| 4,310,945 | 1/1982 | Tribolet | 15/347 |

*Primary Examiner*—Philip R. Coe
*Assistant Examiner*—Gary K. Graham
*Attorney, Agent, or Firm*—Joseph A. Brown

[57] ABSTRACT

Apparatus for a home workshop to collect wood dust from a plurality of work stations and deposit the dust in a container. There are suction hoses, one to each work station. At their outlet ends, the hoses are connected to a single control means operable to selectively connect one hose at a time to the container.

7 Claims, 2 Drawing Sheets

DUST COLLECTION APPARATUS

The present invention relates to apparatus for collecting dust from a plurality of work stations. More particularly, it relates to apparatus for collecting wood dust from work stations in a small shop as might be used by an individual woodworker in a home environment.

Wood dust has been classified by the Environmental Protection Agency, EPA, as a harmful material. Inhalation can cause respiratory problems. It is important therefore that woodworking devices such as saws, planers, sanders and the like be provided with dust collection means. Further, the accumulation of dust on the floor of a woodworking shop also creates a safety hazard.

Commercial woodworking or cabinet shops commonly have relatively effective dust collection systems. However, such systems are elaborate, with a significant cost for each work station being serviced. Control is usually by means of a so-called blast gate at each work station. When an operator moves from one work station to another, he will close the gate at the station vacated and open the gate at the second station. When a particular gate is open, it connects an associated work station to a suction system which will draw off wood dust to a central collection location, usually outside.

Such systems are not readily available to an individual woodworker who has his equipment in a home basement or garage. Among the reasons are size, complexity and cost. Yet, breathing wood dust is just as harmful to a home woodworker as a worker in a commercial operation.

Although the present state of the art provides dust collection apparatus for commercial operations, the individual woodworker at home has little available to him in the way of effective low cost dust collection apparatus. Many home woodworkers will use a broom and dustpan, followed by a conventional shop vacuum cleaner to clean up wood dust. Frequently, too much dust is allowed to accumulate before a clean up occurs, the build up creating a hazardous situation.

It is known to provide a vacuum device with a hose which can be connected to one work station and then moved to other work stations to withdraw wood dust. However, the operator uses considerable time in disconnecting the inlet end of the hose from one work station and moving it for connection to the next work station. At times, the movement of the hose and vacuum device from one station to another will be ignored in the interest of time or inconvenience resulting in wood dust build up.

An object of this invention is to provide low cost dust collection apparatus which is relatively simple to install and convenient to operate.

Another object of this invention is to provide a system whereby a home operator can selectively withdraw wood dust from a plurality of work stations as effectively as equipment provided in commercial woodworking operations, but with apparatus that is inexpensive and efficient in use.

Another object of this invention is to provide wood dust collection apparatus which involves individual suction hoses permanently connected to each work station and means being provided to selectively pick the hose to which a vacuum is to be applied to withdraw wood dust from a particular work station.

A further object of this invention is to provide wood dust collection apparatus in which there is a relatively short suction hose from each work station to a central collection container, the suction efficiency of the hoses being high and the fan noise being low.

Another object of this invention is to provide a system in which there is a suction hose to each of a plurality of work stations, a single control being located at a collection point whereby the operator can select the work station from which wood dust is to be withdrawn.

A still further object of this invention is to provide dust collection apparatus wherein no movement of a suction hose from one work station to another is employed , permanently attached hoses being provided and where the suction force to one work station is closed automatically when a suction force is applied to another work station.

Other objects of the invention will be apparent hereinafter from the following description.

Figure 1:
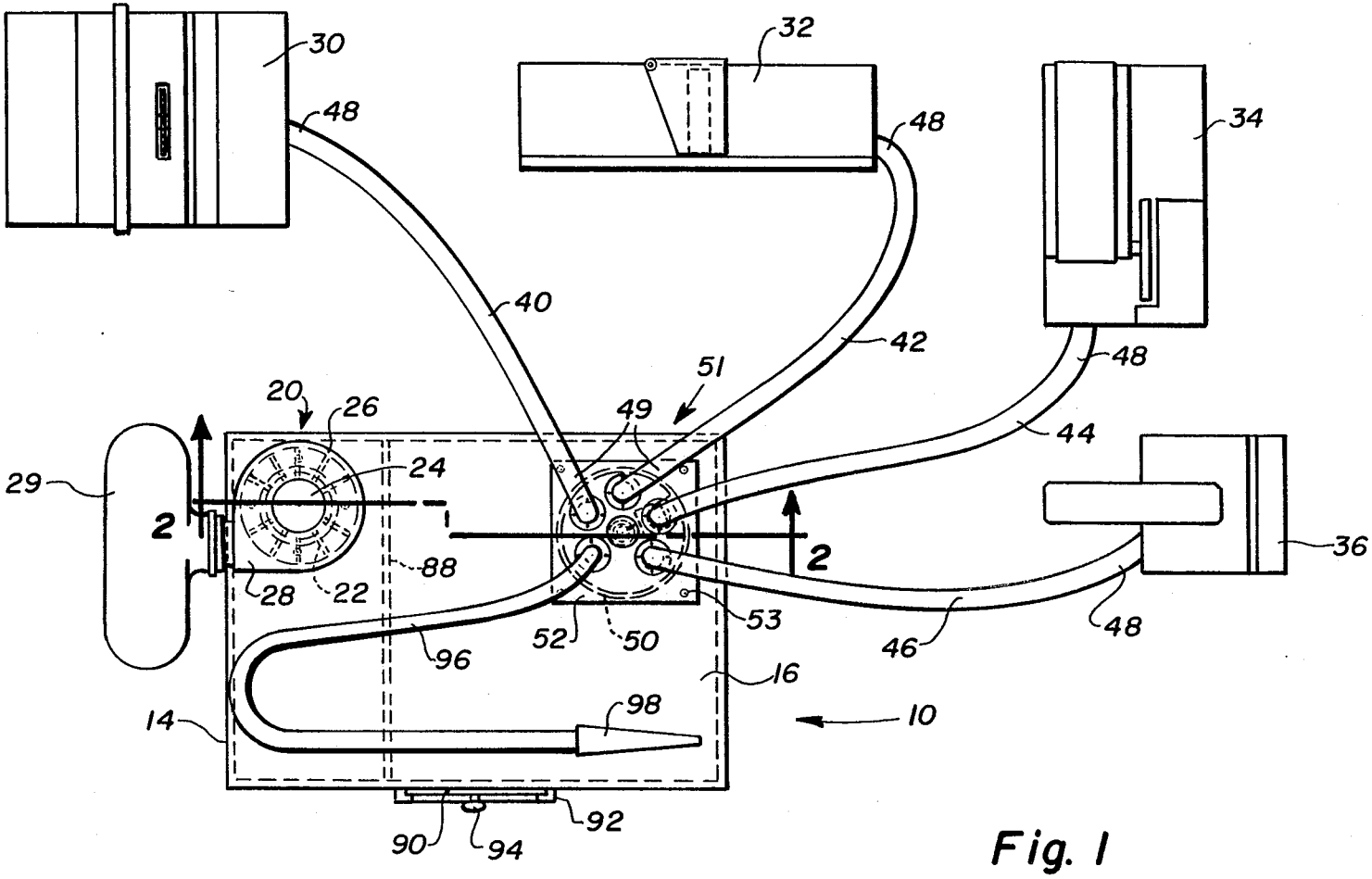
FIG. 1 is a plan view of dust collection apparatus showing a series of wood dust producing tools surrounding a collection container having control means constructed according to this invention.
Figure 2:
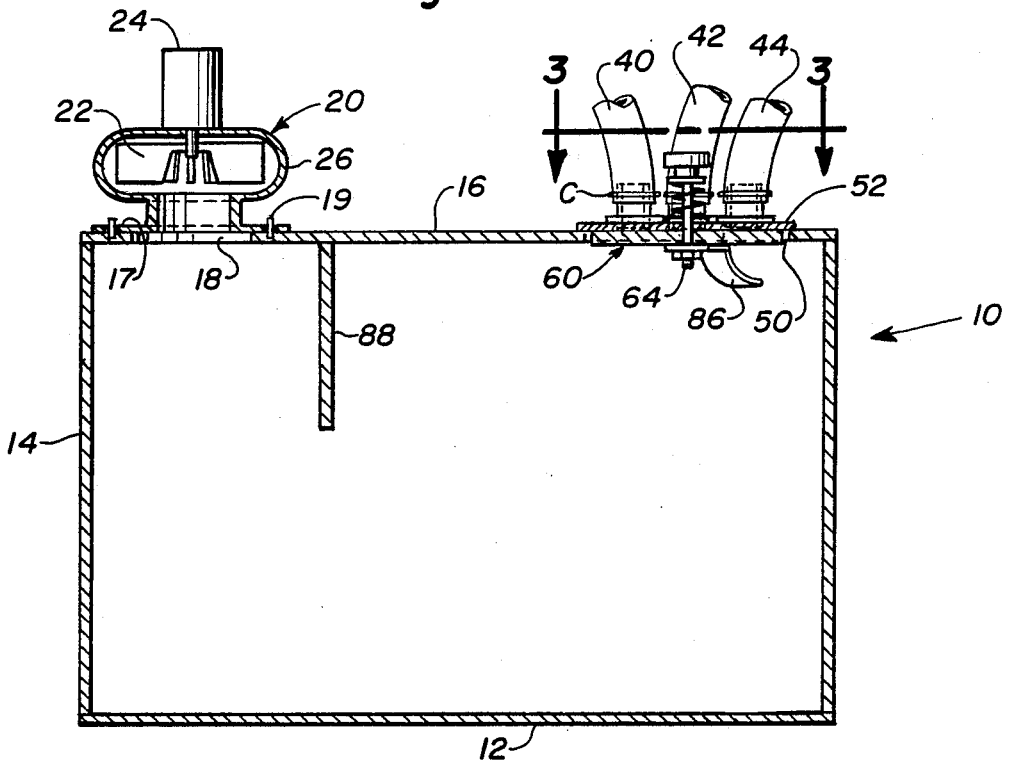
FIG. 2 is a vertical cross-section taken on the lines 2—2 of FIG. 1.

Referring now to the drawings by numerals of reference, and particularly to FIGS. 1 and 2, 10 indicates a wooden box or container having a bottom wall 12, vertical side walls 14 and a horizontal top wall 16. Box 10 is adapted to be supported on the floor of a small wood working shop.

At one location on top wall 16, an opening 18 is provided as shown in FIG. 2. Mounted on top of the container 10 is a fan 20 in closing relationship to the opening 18 and in communication with the inside of box 10. The fan has a mounting flange 17 and is located on wall 16 and opening 18 by means of pins 19. Fan blades 22 are rotated by a motor 24 connected to a suitable electrical power source, not shown. The blades 22 rotate in a housing 26 having a tangential section 28 FIG. 1 to which a conventional exhaust air bag 29 is connected.

Surrounding container 10 on the shop floor are a plurality of wood dust producing work stations. A table saw is diagrammatically illustrated in plan at 30, a planer at 32, a sander at 34 and a band saw at 36. Other woodworking work stations might be employed, these particular devices being illustrative of wood dust producing stations.

As noted from FIG. 1, the container 10 is in generally a central location relative to the woodworking devices located around it. The work stations can be arranged in a manner to suit the lay out of the particular work shop, the objective being to have each station located in close proximity to container 10 .

To withdraw wood dust from the work stations, a plurality of suction hoses are provided there being one hose to each work station, including hose 40 to table saw 30, hose 42 to planer 32, hose 44 to sander 34 and hose 46 to band saw 36. Each hose has an inlet end 48 at its associated work station and an outlet end 49. All hoses extend to a common location at the top of container 10.

Figure 3:
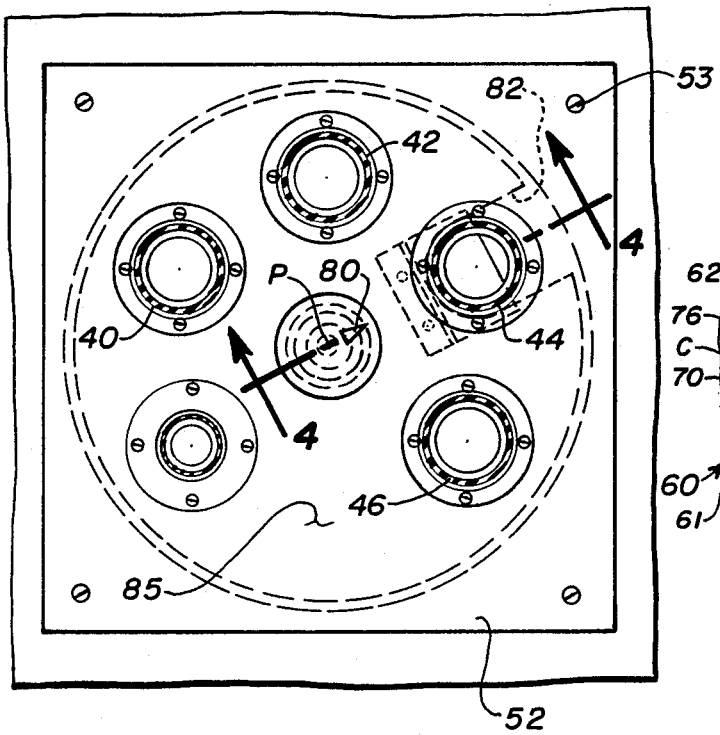
FIG. 3 is an enlarged section taken generally on the line 3—3 of FIG. 2 and showing the means for controlling the suction force from one work station to another.

In order that dust may be withdrawn from the various work stations and deposited in container 10 , top wall 16 is provided with a circular opening 50. When fan 20 is operated, it produces a vacuum in container 10 at the opening 50. To selectively connect one suction hose at a time to container 10, control means 51 constructed according to this invention is provided comprising a horizontal collection plate 52 having a series of vertically extending holes 54 therein. Plate 52 is mounted on top wall 16 of container 10 and connected thereto by fasteners 53. The plate closes opening 50. These holes 54 in plate 52 are located angularly spaced around a central pivot point P, as can be seen in FIG. 3. In the embodiment of the invention shown, plate 52 has five holes. The outlet end 49 of suction hose 40 to table saw 30 is connected to plate 52 at a ten o'clock location. Hose 42 connects planer 32 to plate 52 at a twelve o'clock location and the outlet end of suction hose 44 from sander 34 is connected to plate 52 at two o'clock. The band saw 36 is connected through hose 46 to plate 52 at four o'clock.

Figure 4:
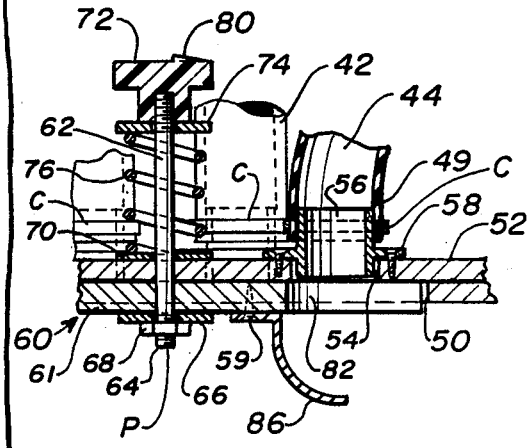
FIG. 4 is a cross-section taken on the line 4—4 of FIG. 3 and showing the details of the control to selectively apply suction from one hose to another.

All of the holes 54 in collection plate 52 are positioned to communicate with the inside of container 10 through opening 50. To facilitate the connection of the outlet ends 49 of the suction hoses to plate 52, a sleeve 56, FIG. 4, is fitted into each hole. Each sleeve has a collar 58 fastened by screws to the collection plate. The internal diameter of each hose is such as to fit snugly over its associated sleeve 56. It can be attached thereto by a friction fit or by means of a clamp C as shown in FIGS. 2 and 4.

To control the suction force at opening 50 in container 10 to the hoses 40, 42, 44 and 46, an air valve 60 is provided comprising a horizontal disc 61 which fits in opening 50 in rotatable engagement with the underside of plate 52. Disc 61 has a vertical pin 62 which slidably extends through collection plate 52. Pin 62 has a threaded lower end 64 threaded to a plate 66 which is secured to the bottom of disc 61 by means such as screws and restricted rotationally by jam nut 68.

Above collection plate 52 around pin 62 is a washer 70 in engagement with the top surface of plate 52. The upper end of pin 62 has a handle or knob 72 secured to it and beneath the handle is a washer 74. Between the washers 70 and 74 is a spring 76 which produces a biasing force on disc 61 in an upward direction against the bottom surface of collection plate 52.

As shown in FIGS. 3 and 4, handle 72 has an indicator arrow 80 thereon. The indicator is directed toward a cut-out hole 82 in disc 61 of air valve 60. Depending on the angular location of hole 82 the suction force to any one of the suction hoses can be controlled. By pressing downwardly on the handle 72, spring 76 is compressed and disc 61 can be moved frictionally away from the under-surface of the collection plate 52. Then air valve 60 can be easily rotated to bring the hole 82 into alignment with any selected hole 54 in plate 52. Indicator 80 enables the operator to align hole 82 with a selected suction hose and the associated hole 54 in the collection plate.

With this construction, there is communication with the inside of the container 10 and the suction force therein with only one hose at a time to a particular work station. At a location 85, FIG. 3, plate 52 has no hole. When the hole 82 in disc 61 is aligned with location 85, then no hole 54 is in communication with container 10. With this construction, the operator can connect any hose to the container 10 or no hose depending upon the position of rotation of air valve 60. Or, the suction force to a hose can be controlled by an electrical shut-off switch, not shown, to the fan 20.

When the operator wishes to use dust collection at a particular work station such as the table saw 30, air valve 60 is rotated to bring the hole 82 in alignment with the hole 54 to which suction hose 40 is connected. Fan 20 is operated. Then, when the table saw is used, wood dust produced at the work station will be withdrawn through the suction hose 40 and deposited in the container 10. If the operator then moves to planer 32, he adjusts disc 6 1 of air value 60 to move indicator 80 into alignment with the hole to which suction hose 42 is connected. Then dust withdrawal occurs from the planer work station. When disc hole 82 is aligned with hole 54 to one of the suction hoses, all of the other hoses are closed off from the suction force.

As the wood dust is sucked into container 10, it enters at a substantial velocity. To slow down the in-flow, and distribute wood dust more uniformly in box 10, a baffle or deflector 86, FIG. 4, is provided which projects across the path of the incoming material to facilitate the heavier elements of the flow to drop to the bottom of the container 10 and for the air to be exhausted from the box into air bag 29 of fan 20. Deflector 86 is fastened to the underside of air valve 60 by screws 59. A baffle 88 is provided in the box 10 as shown in FIG. 2 to prevent heavier wood chips from being directed to the fan inlet through the opening 18.

With the passage of time, saw dust will be accumulated in the container 10 . The box is provided with a clean out door and inspection means 90 slidable from a closed to an open position in frame 92 using a handle 94.

In addition to the hoses to the various work stations, if desired an additional hose 96 can be provided to a hole 54 in connection plate 52 at an eight o'clock location. Hose 96 has a nozzle 98 or other attachment at one end which can be moved around by the operator to vacuum dust and debris from the floor of the work shop or from around any of the units.

As indicated in FIG. 1, the suction hoses to the work stations are relatively short from any work station to container 10 . The shorter the hoses, the greater then efficiency of the fan in the operation in the apparatus. Further, since the fan 20 only has to operate one hose at a time, the fan can be of small size and capacity and still effectively withdraw saw dust from a given work station. By having a small fan, the cost of the overall apparatus is reduced and the noise level is low.

With this invention, the operator can dial any particular suction hose that he wishes to use for the withdrawal of wood dust. The indicator 80 on handle 72 shows the operator which hose is being subjected to a suction force when the fan 20 is turned on. As will be seen, the operator can move from one work station to another and simply by turning locator 80 of air valve 60 a suction force can be applied to any selected hose. For convenience in setting up the system, all of the suction hoses are the same, with a common outside and inside diameter. The lengths of the hoses can be modified to produce the most effective connection to each work station and connection plate 52. All hoses connect to the plate in a similar fashion, fitting on its associated sleeve 56. With this construction, the assembly of the apparatus is facilitated and provides a relatively simple task for the operator to set it up.

Although this invention has been described in connection with a particular embodiment thereof, it will be understood that variations may be made in the structure described without departing from the concept disclosed herein.

Having thus described my invention, what I claim is:

1. Apparatus for collecting wood dust and the like from a plurality of work stations and depositing the dust in a container, said container being supported on a floor and said work stations also being located on said floor grouped around the container in proximity thereto, said container having a top wall extending in a horizontal direction and having a series of holes therein, a plurality of suction hoses, there being one hose for each work station, each hose having an inlet end at an associated work station and an outlet end at said container top wall, means for attaching the outlet ends of the hoses to said container, each to one of said holes, an air valve disc, means mounting said disc on said container for rotational movement relative thereto, said disc having a cut-out registrable with said series of holes one hole at a time depending on the position of rotation of the disc, said disc closing off the other holes when the cut-out is aligned with a selected hole, and means to generate a vacuum in said container.

2. Apparatus for collecting wood dust and the like as recited in claim 1 wherein said container top wall has a dust receiving opening, a collection late fastened to said top wall and closing said opening, said plate being provided with said series of holes arranged in a circle, and said air valve disc being carried on said collection plate in said container opening.

3. Apparatus for collecting wood dust and the like as recited in claim 2 wherein spring means is provided to bias said air valve disc into sliding relation to the underside of said collection plate, said disc being movable downwardly away from said collection plate when the cut-out in the disc is to be moved from register with one hole in the plate to another hole and then released to return toward the collection plate to close said holes other than said one hole.

4. Apparatus for collecting wood dust and the like as recited in claim 2 wherein the holes in said collection plate are angularly spaced from each other around a central pivot, and said air valve disc being rotatable in either direction about said pivot whereby the cut-out in the disc can be selectively moved into register with a desired hole in the collection plate.

5. Apparatus for collecting wood dust and the like as recited in claim 2 wherein indicator means is provided to enable alignment of the cut-out in the air valve disc with a selected hole in said collection plate.

6. Apparatus for collecting wood dust and the like as recited in claim 2 wherein a sleeve is attached to each collection plate hole to receive the outlet end of one of said suction hoses, and said attaching means connecting each hose to an associated sleeve.

7. Apparatus for collecting wood dust and the like as recited in claim 2 wherein a baffle is mounted on the underside of said disc adjacent said disc cut-out and across the stream of incoming dust to distribute material entering the container and facilitate the dropping of heavier particles to the bottom of the container.

* * * * *